US006811244B2

(12) United States Patent
Kimura

(10) Patent No.: US 6,811,244 B2
(45) Date of Patent: Nov. 2, 2004

(54) IMAGE RECORDING APPARATUS AND MAINTENANCE METHOD OF RECORDING HEAD OF THE SAME

(75) Inventor: Kazuhisa Kimura, Hiratsuka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/403,091

(22) Filed: Apr. 1, 2003

(65) Prior Publication Data

US 2004/0100520 A1 May 27, 2004

(30) Foreign Application Priority Data

Nov. 26, 2002 (JP) ..... 2002-342670

(51) Int. Cl.[7] ..... B41J 2/165
(52) U.S. Cl. ..... 347/30; 347/23; 347/29
(58) Field of Search ..... 347/19, 22, 23, 347/29, 30

(56) References Cited

U.S. PATENT DOCUMENTS

| | | | | |
|---|---|---|---|---|
| 5,543,826 A | * | 8/1996 | Kuronuma et al. | 347/23 |
| 5,699,095 A | * | 12/1997 | Mitsuzawa et al. | 347/92 |
| 5,793,390 A | * | 8/1998 | Claflin et al. | 347/33 |
| 5,805,180 A | * | 9/1998 | Ebisawa et al. | 347/23 |
| 6,120,126 A | * | 9/2000 | Nakahara | 347/23 |
| 6,334,662 B2 | * | 1/2002 | Hollands | 347/22 |
| 6,641,247 B2 | * | 11/2003 | Ide et al. | 347/23 |

FOREIGN PATENT DOCUMENTS

| | | |
|---|---|---|
| EP | 0 318 329 | 5/1989 |
| EP | 0 499 432 | 8/1992 |
| EP | 1 043 161 | 10/2000 |
| JP | 5-220970 | 8/1993 |
| JP | 6-135004 | 5/1994 |

OTHER PUBLICATIONS

Patent Abstracts of Japan, JP 02–006142, Jan. 10, 1990.

European Search Report, EP 03 00 7643, Jul. 24, 2003, Urbaniec, T.

* cited by examiner

*Primary Examiner*—Shih-Wen Hsieh
(74) *Attorney, Agent, or Firm*—Oblon, Spivak, McClelland, Maier & Neustadt, P.C.

(57) ABSTRACT

An image recording apparatus includes a recording head which has an ink discharge nozzle to discharge ink and an ink non-discharge nozzle to eliminate bubbles, a suction unit which makes suction for maintenance by moving a suction nozzle on the ink discharge side of the recording head, contacting with or closing to the ink discharge nozzle surface of the recording head, and a control unit which controls the suction unit to make suction by a first suction force when the suction nozzle is in the position corresponding to the ink discharge nozzle and by a second suction force when the suction nozzle is in the position corresponding to the ink non-discharge nozzle.

10 Claims, 4 Drawing Sheets

IMAGE RECORDING APPARATUS AND MAINTENANCE METHOD OF RECORDING HEAD OF THE SAME

CROSS-REFERENCE TO RELATED APPLICATIONS

This application is based upon and claims the benefit of priority from the prior Japanese Patent Application No. 2002-342670, filed Nov. 26, 2002, the entire contents of which are incorporated herein by reference.

BACKGROUND OF THE INVENTION

1. Field of the Invention

The present invention relates to an image recording apparatus which executes maintenance of a recording head by moving a suction nozzle contacting with or closing to the recording head surface, and a maintenance method of the recording head of the image recording apparatus.

2. Description of the Related Art

Conventional-maintenance method and mechanism of a recording head, for example, an ink jet head are to eliminate bubbles generated in an ink chamber in an ink jet head by discharging ink from an ink discharge port by pressurizing an ink supply chamber, or by absorbing bubbles from an ink discharge port by means of a suction nozzle or a cap means. This maintenance method is the same as a method of eliminating bubbles through a vent comprising an ink non-discharge nozzle provided at both ends of an ink jet head, in order to maintain the printing performance of an ink jet head, for example, when bubbles mix into an ink chamber during filling ink or other operations. This makes it possible to eliminate bubbles easily without using a special method of eliminating bubbles.

However, in this method, the suction pressure of a suction nozzle is held constant as a suction force not absorbing air or dust from an adjacent ink discharge nozzle. Therefore, this suction force of a suction nozzle is insufficient to absorb bubbles from an ink non-discharge nozzle whose passage resistance is larger than that of an ink discharge nozzle. Further, if the suction force of the suction nozzle is set to the valve for the ink non-discharge nozzle to enable to absorb bubbles, the absorbing force is too strong for the ink discharge nozzle and breaks the meniscus formed within the ink discharge nozzle.

There is another known method of absorbing bubbles through different absorbing routes by providing first and second caps in one capping member and switching them with a solenoid valve. However, absorption of bubbles through two different routes complicates the structure.

Thus, there is the need for an image recording apparatus which can perform maintenance of a recording head easily with a simple structure, and a maintenance method of the recording head of the image recording apparatus.

BRIEF SUMMARY OF THE INVENTION

According to an aspect of the present invention, there is provided an image recording apparatus comprising a recording head which has an ink discharge nozzle to discharge ink and an ink non-discharge nozzle to eliminate bubbles; a suction unit which makes suction for maintenance by moving a suction nozzle on the ink discharge side of the recording head, contacting with or closing to the ink discharge nozzle surface of the recording head; and a control unit which controls the suction unit to make suction by a first suction force when the suction nozzle is in the position corresponding to the ink discharge nozzle and by a second suction force when the suction nozzle is in the position corresponding to the ink non-discharge nozzle.

Objects and advantages of the invention will become apparent from the description which follows, or may be learned by practice of the invention.

BRIEF DESCRIPTION OF THE SEVERAL VIEWS OF THE DRAWING

The accompanying drawings illustrate embodiments of the invention, and together with the general description given above and the detailed description given below, serve to explain the principles of the invention.

DETAILED DESCRIPTION OF THE INVENTION

Hereinafter, embodiments of the present invention will be explained with reference to the attached drawings.

First Embodiment

Figure 1:
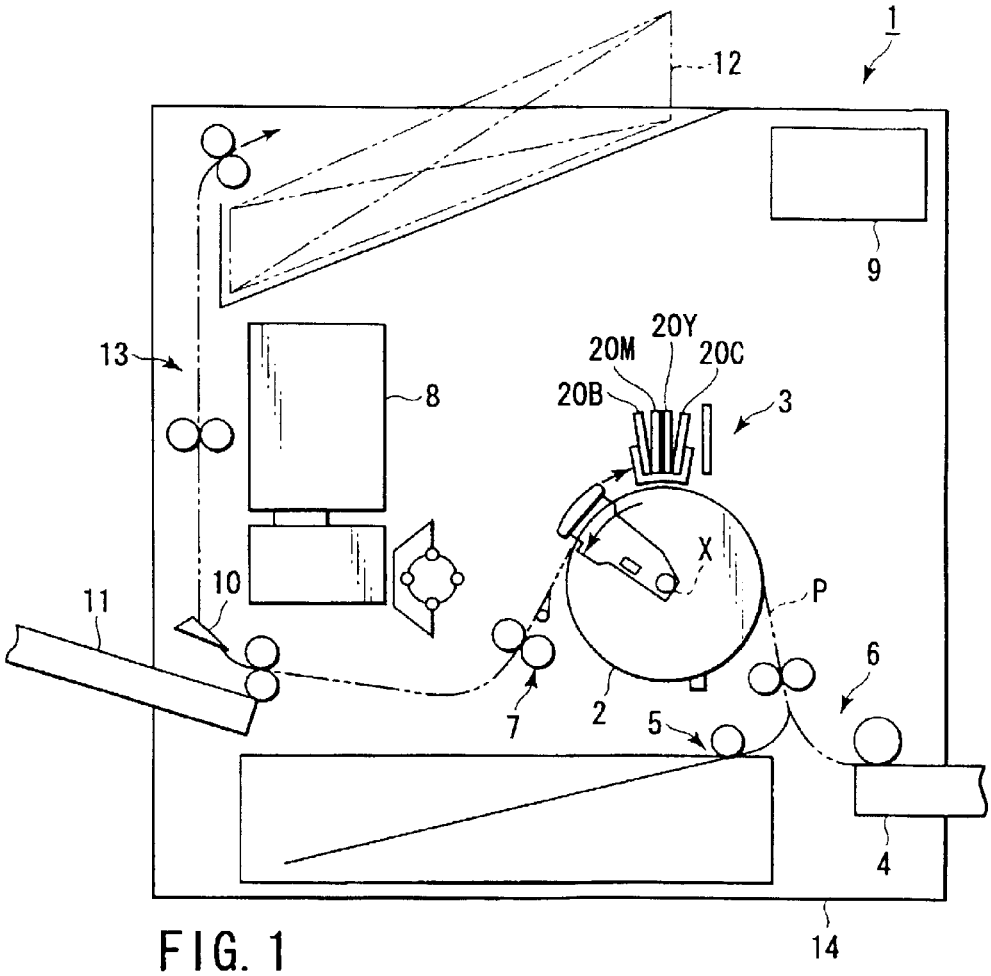
FIG. 1 is a schematic diagram showing the internal structure of an ink jet recording apparatus according to a first embodiment of the present invention.

FIG. 1 is a schematic diagram showing the internal structure of an image recording apparatus or an ink jet recording apparatus 1. The ink jet recording apparatus 1 performs color printing on a recording medium or paper P. The paper P is a plain paper, a coated paper or an OHP sheet, for example.

The ink jet recording apparatus 1 comprises a drum 2, a printing unit 3, a manual feed tray 4, a paper cassette 5, a paper feed mechanism 6, a paper eject mechanism 7, an ink supply system 8, and a control unit 9. The drum 2 rotates at a predetermined speed with paper wound around its outer circumference. The printing unit 3 makes color printing on paper. The manual feed tray 4 supplies the paper P stacked thereon one by one. The paper cassette 5 contains the paper P. The paper feed mechanism 6 feeds the paper P supplied from the manual feed tray 4 or paper cassette 5, and contacted with the drum 2. The paper eject mechanism 7 ejects the paper P printed by the rotation of the drum 2. The paper P, ejected by the paper ejection mechanism 7 is ejected by a paper carry mechanism 13 to an ejected paper tray 11 or to an ejected paper tray 12 provided at the top of the ink jet recording unit 1, selectively delivered by an ejected paper switch 10. The ink supply system 8 supplies ink. The control unit 9 generally controls each unit of the ink jet recording apparatus 1.

Figure 2:
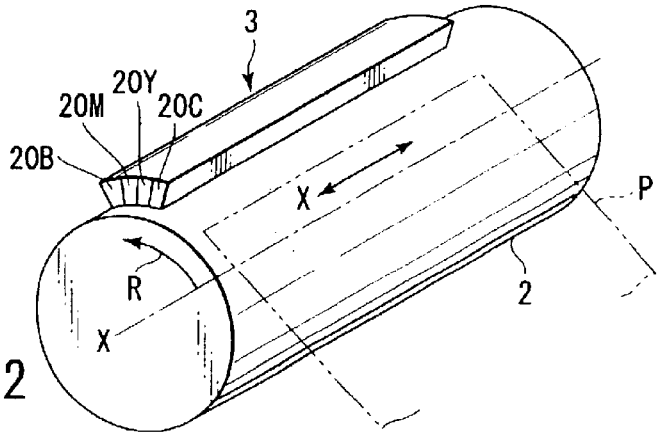
FIG. 2 is view showing the positional relationship between a drum and a nozzle unit.

As shown in FIG. 1, the drum 2 is located at almost the center of a housing 14. The manual feed tray 4 is located downward the drum 2, extending from one wall of the housing 14. The paper cassette 5 is located below the drum 2. The paper feed mechanism 6 is located upstream the drum 2. The printing unit 3 is located on the drum 2. The paper eject mechanism 7 is located downstream the drum 2. The drum 2 is held by the axis X. The drum 2 winds the paper P around its circumference along the rotating direction indicated by the arrow R in FIG. 2.

In the printing unit 3, four nozzle units 20C (cyan), 20Y (yellow), 20M (magenta) and 20B (black) are arranged above the circumference of the drum 2 in this order from upstream to downstream for printing the paper P. The nozzle units 20C, 20Y, 20M and 20B are supplied with ink of respective colors from the ink supply system 8. In each nozzle unit of 20C, 20Y, 20M and 20B, a plurality of ink jet heads arranged in the X-axis direction of the drum.

Figure 3:
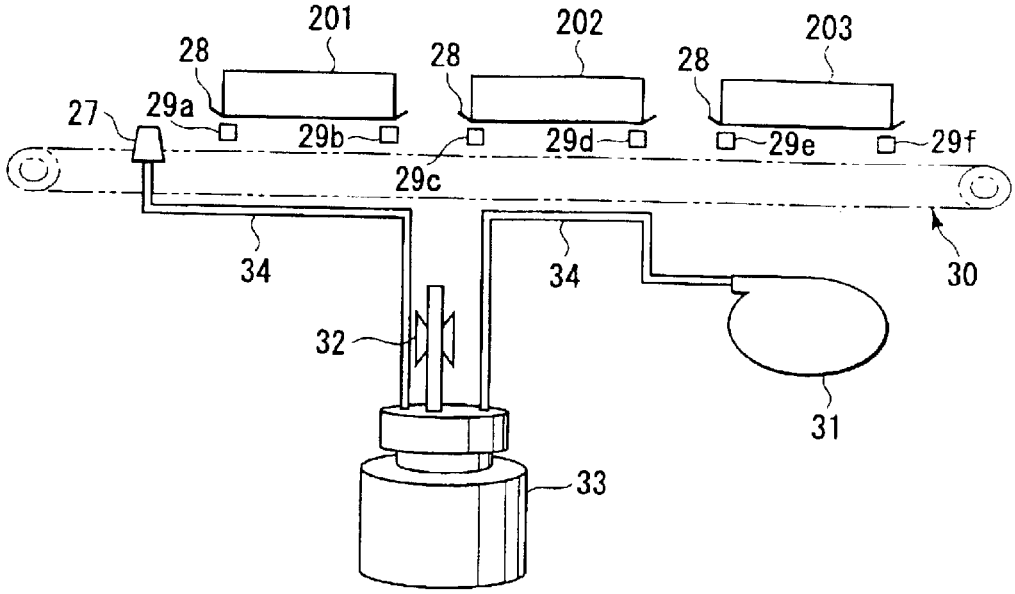
FIG. 3 is a view for explaining the maintenance mechanism of the ink jet head.
Figure 4:
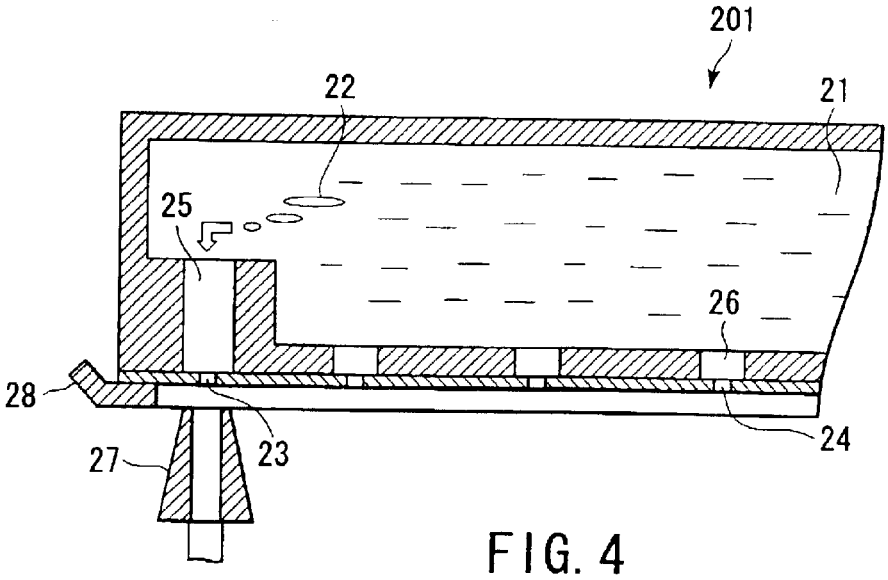
FIG. 4 is a view showing the cross section of the ink jet head.

FIG. 3 shows the maintenance mechanism of the nozzle unit of the ink jet recording apparatus 1 which is configured as described above. FIG. 4 shows the internal structure of the ink jet head.

Each of the above-mentioned color nozzle units 20C, 20Y, 20M and 20B comprises a plurality of ink jet heads, for example, three ink jet heads 201, 202 and 203, which are mounted on a board (not shown), so that their lengthwise directions become parallel to the X-axis direction.

The internal structure common to these ink jet heads 201, 202 and 203 will now be explained by referring to FIG. 4. For example, one end of the ink jet head 201 is shown.

The ink jet head 201 contains a common ink chamber 21 to be filled with ink. The cross section of the common ink chamber 21 is rectangle with one side opened, and has a different level portion at a part of its end. The common ink chamber 21 is filled with ink. Bubbles or dust 22 generated during filling the ink or other operations mix into the ink chamber 21.

At the bottom of the ink jet head 201, one ink non-discharge nozzle 23 is provided near the end, and a plurality of ink discharge nozzles 24 is provided at fixed intervals from the ink non-discharge nozzle 23. Though it is not shown, another ink non-discharge nozzle 23 is also provided near the end opposite to the is above-mentioned end. The ink non-discharge nozzle 23 is connected the common ink chamber 21 through the ink non-discharge nozzle section 25 having predetermined passage length and diameter. The ink non-discharge nozzle 23 and ink non-discharge nozzle section 25 form a vent. Each ink discharge nozzle 24 is connected to the common ink chamber 21 through each ink discharge nozzle section 26 having predetermined passage length and diameter. In this embodiment, the passage resistance determined by the passage lengths and diameters of the ink non-discharge nozzle section 25 and ink discharge nozzle section 26, is larger in the ink non-discharge nozzle section 25.

The passage resistance will be explained in detail. When sucking ink from the ink non-discharge nozzle section 25 and ink discharge nozzle section 26, an action to disturb the flow of liquid occurs when the ink or liquid flows in the nozzle section, that is, a passage resistance occurs. The passage resistance is a frictional force (viscosity resistance) caused by the liquid with viscosity (viscous fluid) and the inside wall of the passage. As for the viscosity of liquid, Poiseuille's law is known. According to the Poiseuille's law, when the passage radius is a, the passage length is l and the fluid is a horizontal stationary flow with the coefficient of viscosity $\eta$, the volume V of the fluid flowing within t seconds is expressed by the equation $V=(\pi a^4 t\Delta p)/(8\ I\ V)$, assuming that the pressure difference at both ends of the horizontal stationary flow (the pressure difference between the inlet and outlet of the passage) to be $\Delta p$. The above equation can be transformed to $V=(\pi a^4 t\Delta p)/(8\ I\eta)$. Therefore, it is known that the flow volume in the passage is inversely proportional to the passage length l, and directly proportional to the passage radius a.

A protection material 28 to protect the head nozzle surface is provided under the ink jet head 201. When a suction nozzle 27 is used for maintenance of the head nozzle surface and the suction nozzle 27 contacts the head nozzle surface, the head nozzle surface is scratched and damaged causing failure in maintaining the basic characteristics of the head. The protection material 28 is provided outside of the head nozzle surface to prevent such damages. The protection material 28 can also prevent damages to occur on the head nozzle surface, when the gap between the head and the printing surface is adjusted. There is a possibility of applying an external force to the head nozzle surface when transporting the ink jet head 201. The protection material 28 can also protect the nozzle surface in this case.

When the ink non-discharge nozzle 23 and each ink discharge nozzle 24 are used for maintenance of the ink jet head 201 arranged on the ink discharge surface, the suction nozzle 27 contacts the ink discharge surface. It is also permitted to configure to bring the suction nozzle 27 close to the ink discharge surface during maintenance.

Next, the maintenance mechanism of the ink jet heads 201, 202 and 203 will be explained by referring to FIG. 3. A maintenance drive unit 30 is provided under the discharge surface of the ink jet heads 201, 202 and 203, so as to be almost parallel to the alignment direction of these ink jet heads 201, 202 and 203. The suction nozzle 27 reciprocates along the maintenance drive unit 30. Position detecting sensors 29*a*, 29*b*, 29*c*, 29*d*, 29*e* and 29*f* are provided to detect the position of the suction nozzle 27. These position detecting sensors 29*a*, 29*b*, 29*c*, 29*d*, 29*e* and 29*f* are provided to detect that the suction nozzle 27 reaches the position corresponding to the ink non-discharge nozzle 23, when the suction nozzle 27 moves along the maintenance drive unit 30. That is, as shown in FIG. 3, the sensors are located at six positions. Each of the position detecting sensors 29*a*, 29*b*, 29*c*, 29*d*, 29*e* and 29*f* is an opto-interrupter, for example, and is constructed to receive the light from a light emitting element by a light receiving element. The nozzle 27 passes along these sensors.

The suction nozzle 27 is connected to a suction pump 31 via a suction tube 34. The suction tube 34 passes through a suction ink recovery bottle 33 with a pressure adjusting valve 32 to adjust the suction pressure of the suction pump 31.

Figure 5:
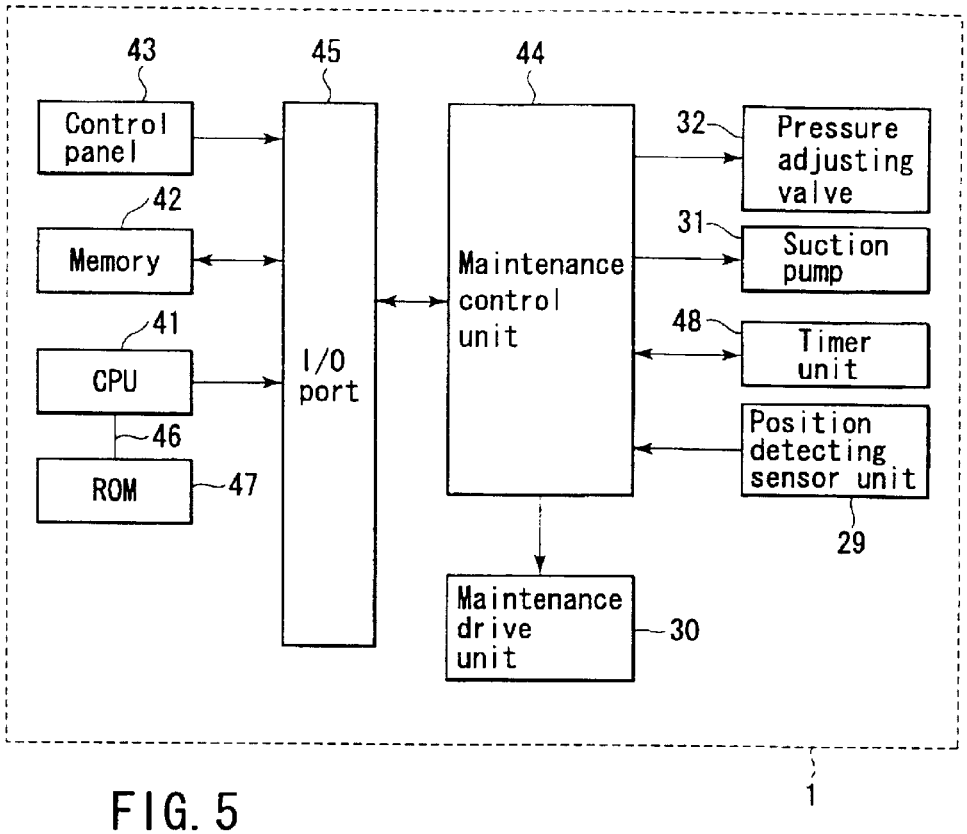
FIG. 5 is a schematic diagram showing the control unit of the ink jet recording apparatus.

Description will now be given on the control mechanism for maintenance of the printing unit 3 of the ink jet recording apparatus 1 with reference to FIG. 5.

A CPU 41, a memory 42, a control panel 43 and a maintenance control unit 44 are connected to an I/O port 45. The CPU 41 is connected to a ROM 47 via a bus line 46. The maintenance control unit 44 is connected to the maintenance drive unit 30, the pressure adjusting valve 32, the suction pump 31, a timer unit 48, and position detecting sensors 29*a*, 29*b*, 29*c*, 29*d*, 29*e* and 29*f*.

The CPU 41 realizes operation as the ink jet recording apparatus 1 based on the control program stored in the ROM 47. The control panel 43 sends information to the user and receives instructions from the user, under the control of the CPU 41.

The maintenance control unit 44 is a control circuit to control maintenance. The maintenance control unit controls the maintenance drive unit 30, pressure adjusting valve 32, suction pump 31, timer unit 48 and position detecting sensors 29, to execute maintenance.

The memory 42 stores various data and setting, for example, the maintenance start position determined for each color ink jet head and the order of the ink jet heads for executing maintenance. The memory 42 also stores the suction time of the ink non-discharge nozzle 23, and the suction pressure by opening the pressure adjusting valve 32. For example, the valve increase the opening to decrease the suction pressure when the suction nozzle 27 make suction from the discharge nozzle 24, and the valve reduce the opening to increase the pressure when the suction nozzle 27 makes suction from the ink non-discharge nozzle 23. The opening degree of the pressure adjusting valve is determined considering the passage resistance, which is determined by the passage lengths and diameters of the ink non-discharge nozzle 25 and ink discharge nozzle 26.

The maintenance drive unit 30 reciprocates the suction nozzle 27 along a predetermined direction. The suction pump 31 makes the suction operation by a predetermined pressure.

The pressure adjusting valve 32 is controlled by the maintenance control unit 44, and adjusts the suction pressure of the suction nozzle 27 by adjusting the degree of vacuum in the suction ink recovery bottle.

The timer unit 48 creates time information. The position detecting sensor unit 29 consists of position detecting sensors 29*a*–29*f*, and as above explained, detects whether the suction nozzle 27 reaches the position of the ink non-discharge nozzle 23. For example, the position detecting sensor turns on when the position of the suction nozzle 27 corresponds to the position of the ink non-discharge nozzle 23, and turns off when the position of the suction nozzle does not correspond to the position of the ink non-discharge nozzle 23.

Figure 6:
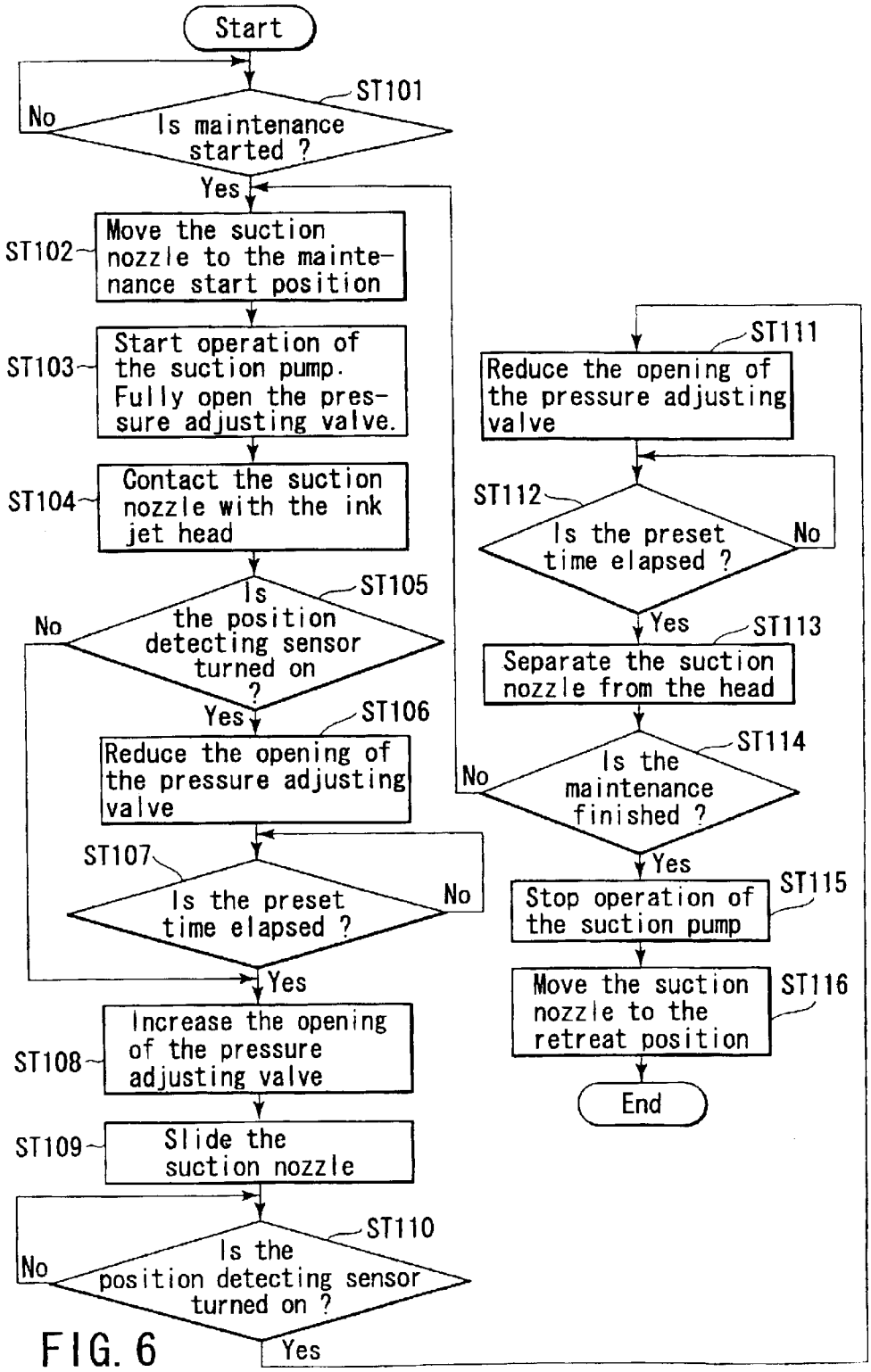
FIG. 6 is a flow chart showing the maintenance procedure.

Description will now be given on the maintenance executed by the maintenance control unit 44 by referring to the flow chart of FIG. 6.

First, in step ST101, the maintenance control unit 44 determines whether to execute maintenance. Go to step ST102 when YES, and wait when NO. Maintenance is executed at the timing, for example, when the maintenance start instruction is received from the control panel 43, or when execution of maintenance is previously set after the power switch is turned on.

In step ST102, the maintenance control unit 44 controls the maintenance drive unit 30 to move the suction nozzle 27 from the retreat position to the maintenance start position. In step ST103, the maintenance control unit 44 starts suction of the suction pump 31. In this time, the maintenance control unit 44 fully opens the pressure adjusting valve 32. This starts suction from the suction nozzle 27. In step ST104, the maintenance control unit 44 controls the maintenance drive unit 30 to make the suction nozzle 27 contact with the ink discharge surface of the ink jet head. It is also permitted to make the suction nozzle 27 close to the ink discharge surface of the ink jet head.

In step ST105, the maintenance control unit 44 determines whether the position detecting sensor unit 29 detects the suction nozzle 27. Go to step ST106 when YES, and go to step ST108 when NO.

In step 106, the maintenance control unit 44 selectively reads from the memory 42 the setting for suction of ink from the ink non-discharge nozzle 23, and reduce the opening of the pressure adjusting valve 32, that is, increases the suction force to perform suction from the ink non-discharge nozzle 23.

In step 107, the maintenance control unit 44 determines, based on the time counted by the timer unit 48, whether the time stored in the memory 42 to perform suction from the ink non-discharge nozzle 23 elapses. Suction is performed until the suction time expires, and after expiration of the suction time, go to step ST108.

In step ST108, the maintenance control unit 44 selectively reads from the memory 42 the setting for suction of ink from the ink discharge nozzle 24, and increase the opening of the pressure adjusting valve 32, that is, decreases the suction force to perform suction from the ink discharge nozzle 24. And, in step ST109, the maintenance control unit 44 controls the maintenance drive unit 30 to slide the suction nozzle 27 by making it contact with the ink discharge surface of the ink jet head. By this operation, the ink and dust adhered to the surface of the ink discharge side can be eliminated.

In step ST110, the maintenance control unit 44 determines whether the position detecting sensor unit 29 detects the suction nozzle 27. The position detecting sensor to detect the suction nozzle 27 in this time is the sensor located at the end of the opposite side of the sensor which performed the last detection. According to the decision, the suction nozzle 27 is slid until the position detecting sensor 29 detects the suction nozzle 27. When the suction nozzle 27 is detected, go to step ST111.

In step ST111, the maintenance control unit 44 selectively reads from the memory 42 the setting for suction of ink from the ink non-discharge nozzle 23, and reduce the opening of the pressure adjusting valve 32, that is, increases the suction force to perform suction from the ink non-discharge nozzle 23.

In step ST112, the maintenance control unit 44 determines, based on the time counted by the timer unit 48, whether the time stored in the memory 42 to perform suction from the ink non-discharge nozzle 23 elapses. Suction is performed until the suction time expires, and after expiration of the suction time, go to step ST113.

In step ST113, the maintenance control unit 44 separates the suction nozzle 27 from the ink discharge surface of the ink jet head. This completes maintenance of one ink jet head.

In step ST114, the maintenance control unit 44 determines whether to finish the maintenance, that is, whether the maintenance of all the three ink jet heads provided for each color is finished. When NO, go back to step ST102. At this time, in step 102, the maintenance control unit moves the suction nozzle 27 to the next ink jet head maintenance start position. When YES, go to step ST115.

In step ST115, the maintenance control unit 44 stops the suction operation of the suction pump 31. In step ST116, the maintenance control unit 44 controls the maintenance drive unit 30 to move the suction nozzle 27 to the retreat position. The maintenance is finished by this operation.

Therefore, even if the passage resistance is different in the ink non-discharge nozzle 23 and ink discharge nozzle 24, the opening of the pressure adjusting valve 32 is adjusted to provide a suction force suitable for each nozzle. And, based on the detection of the suction nozzle 27 by the position detecting sensor unit 29, the pressure adjusting valve 32 is adjusted to provide a suction force suitable for the ink non-discharge nozzle 23 when the suction nozzle 27 reaches the position of the non-discharge nozzle 23, and a suction force suitable for the ink discharge nozzle 24 when the suction nozzle reaches the position of the ink discharge nozzle 24.

As described above, when sucking ink from the ink non-discharge nozzle 23 having a large passage resistance, increase the suction force of the suction nozzle 27 by reducing the opening of the pressure adjusting valve 32. This makes it possible to suck out the bubbles and dust generated in the common ink chamber 21 through the ink non-discharge nozzle 23. When sucking ink from the ink discharge nozzle 24 having a small passage resistance, decrease the suction pressure by increasing the opening of the pressure adjusting valve 32. This can prevent suction of air and dust from the ink discharge nozzle adjacent to the ink discharge nozzle 24 which sucks ink.

This embodiment is configured to adjust the ink non-discharge nozzle 23 and ink discharge nozzle 24 by the pressure adjusting valve 32. However, it is also permitted to make the suction pressure same in the ink non-discharge nozzle 23 and ink discharge nozzle 24, and to adjust the suction time.

As explained above, the ink jet recording apparatus 1 can suck out bubbles and dust from the common ink chamber 21 by one suction nozzle by adjusting the suction force to the ink non-discharge nozzle 23 and ink discharge nozzle 24 having a different passage resistance. It is also possible to eliminate the ink and dust adhered to the surface of the ink discharge side of the ink jet head. This enables maintenance of the ink jet head easily with a simple structure without breaking the meniscus in the ink discharge nozzle.

Second Embodiment

A second embodiment will be explained. The same reference numerals are given to the same components as those of the first embodiment, and the detailed explanation will be omitted.

Figure 7:
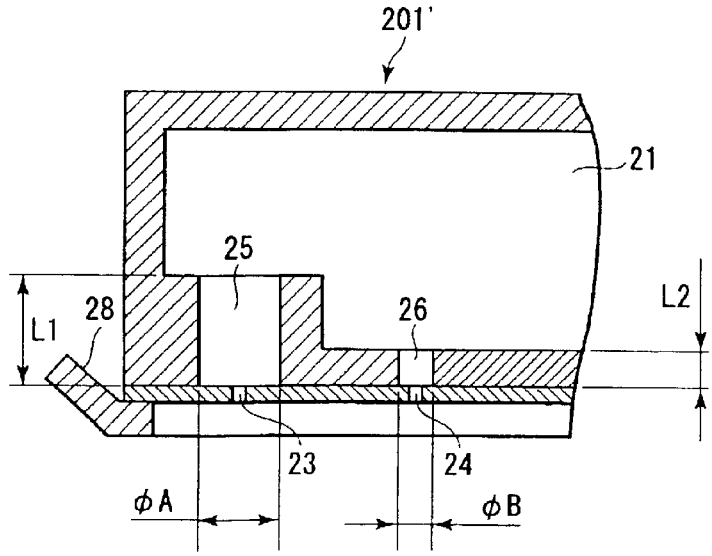
FIG. 7 is a view showing the cross section of the end of the ink jet head according to a second embodiment of the present invention.

The end part of an ink jet head 201 of this embodiment is configured as shown in FIG. 7. The passage length of an ink non-discharge nozzle section 25 is L1, the passage diameter is ΦA. The passage length of the ink discharge nozzle section 26 is L2, and the passage diameter is ΦB. When the passage diameter is ΦA and the passage length is L1, the flow rate flowed by the suction force of the suction nozzle 27 in the ink discharge nozzle section 26 within t seconds is V1. When the passage diameter is ΦB and the passage length is L2, the flow rate flowing in the ink non-discharge nozzle section 25 within t seconds is V2. The ink jet head of this embodiment is configured to be V1=V2, that is, to have the same ink passage resistance. Therefore, as the passage length of the ink non-discharge nozzle section 25 is longer than that of the ink discharge nozzle section 26, the passage diameter of the nozzle 25 is set larger.

The time of suction by the suction nozzle 27 from the ink non-discharge nozzle 23 is controlled to be different from the time of suction by the suction nozzle 27 from the ink discharge nozzle 24.

The same effect as the first embodiment can be obtained with this structure. Further, since the suction force can be set to the same for the ink non-discharge nozzle 23, ink discharge nozzle 24 and suction nozzle 27, the pressure adjusting valve 32 can be omitted.

In the above-mentioned embodiments, the present invention is applied to a color printing ink jet recording apparatus, the invention can also be applied to a monochrome printing ink jet recording apparatus.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the invention as defined by the appended claims and their equivalents.

What is claimed is:

1. An image recording apparatus comprising: a recording head which has an ink discharge nozzle to discharge ink and an ink non-discharge nozzle to eliminate bubbles;

a suction unit which makes suction for maintenance by moving a suction nozzle on an ink discharge side of the recording head, contacting with or closing to discharge nozzle surface of the recording head; and a control unit which controls the suction unit to suck by a first suction force when the suction nozzle is in a position corresponding to the ink discharge nozzle and by a second suction force when the suction nozzle is in the position corresponding the ink non-discharge nozzle.

2. The image recording apparatus according to claim 1, wherein the suction unit has a pressure adjusting valve to adjust a suction force, and the control unit controls the pressure adjusting valve to make suction by a first suction force or a second suction force.

3. The image recording apparatus according to claim 2, further comprising a position detecting sensor which detects the position of the suction nozzle with respect to the ink discharge nozzle surface of the recording head, wherein the control unit controls the pressure adjusting valve based on the suction nozzle position detected by the position detecting sensor.

4. The image recording apparatus according to claim 1, wherein passage resistance of the ink discharge nozzle and ink non-discharge nozzle is the same.

5. The image recording apparatus according to claim 4, further comprising a timer unit which counts time, wherein the control unit controls the suction time of the suction unit based on the time counted by the timer unit.

6. A maintenance method of a recording head of an image recording apparatus having a recording head which has an ink discharge nozzle for discharging ink and an ink non-discharge nozzle for eliminating bubbles, comprising:

moving a suction nozzle on an ink discharge side of the recording head, contacting with or closing to an ink discharge nozzle surface of the recording head, for the suction for maintenance of the recording head;

making suction by a first suction force when the suction nozzle is in a position corresponding to the ink discharge nozzle; and making suction by a second suction force when the suction nozzle is in the position corresponding to the ink non-discharge nozzle.

7. The method according to claim 6, wherein the first suction force and the second suction force are obtained by adjusting a pressure adjusting valve to adjust a suction force.

8. The method according to claim 7, further comprising:

detecting the position of the suction nozzle with respect to the ink discharge nozzle surface of the recording head; and adjusting the pressure based on the detected position.

9. The method according to claim 6, wherein passage resistance of the ink discharge nozzle and ink non-discharge nozzle is the same.

10. The method according to claim 9, further comprising:

counting suction time; and controlling the suction time based on the counted time.

* * * * *